US011008640B2

(12) United States Patent
Minagawa et al.

(10) Patent No.: US 11,008,640 B2
(45) Date of Patent: May 18, 2021

(54) ALUMINUM ALLOY FOR LOW-PRESSURE CASTING

(71) Applicants: UACJ CORPORATION, Tokyo (JP); UACJ Foundry & Forging Corporation, Tokyo (JP)

(72) Inventors: Akihiro Minagawa, Tokyo (JP); Toshio Ushiyama, Tokyo (JP)

(73) Assignees: UACJ Corporation, Tokyo (JP); UACJ Foundry & Forging Corporation, Tokyo (JP)

( * ) Notice: Subject to any disclaimer, the term of this patent is extended or adjusted under 35 U.S.C. 154(b) by 125 days.

(21) Appl. No.: 16/338,051

(22) PCT Filed: Oct. 30, 2017

(86) PCT No.: PCT/JP2017/039047
§ 371 (c)(1),
(2) Date: Mar. 29, 2019

(87) PCT Pub. No.: WO2018/084103
PCT Pub. Date: May 11, 2018

(65) Prior Publication Data

US 2019/0233920 A1 Aug. 1, 2019

(30) Foreign Application Priority Data

Nov. 1, 2016 (JP) ..... JP2016-214003
May 9, 2017 (JP) ..... JP2017-093238

(51) Int. Cl.
*C22C 21/02* (2006.01)
*B22D 21/00* (2006.01)
(Continued)

(52) U.S. Cl.
CPC ..... *C22C 21/02* (2013.01); *B22D 18/04* (2013.01); *B22D 21/007* (2013.01); *B22D 21/04* (2013.01); *C22C 1/02* (2013.01)

(58) Field of Classification Search
CPC ..... B22D 21/04; B22D 21/007; B22D 18/04; C22C 221/02; C22C 21/02
See application file for complete search history.

(56) References Cited

U.S. PATENT DOCUMENTS 6,336,955 B1 1/2002 Suzuki et al.
2015/0344992 A1* 12/2015 Oda ..... B22D 27/20 75/684
2017/0327930 A1* 11/2017 Kitawaki ..... G11B 5/7315

FOREIGN PATENT DOCUMENTS

EP 1978120 B1 * 6/2012 ..... C22C 21/02
JP 1-319646 A 12/1989
(Continued)

*Primary Examiner* — Anthony J Zimmer
*Assistant Examiner* — Jacob James Gusewelle
(74) *Attorney, Agent, or Firm* — Roberts & Roberts, LLP

(57) ABSTRACT

An aluminum alloy for casting, made of an Al—Si—Cu—Mg alloy which consists of specific amounts of Si, Cu, and Mg, in addition to specifically desired amounts of titanium, phosphorus, boron, and optional additional chemical elements sodium and strontium, with the balance of the aluminum alloy comprising aluminum and any impurities. When a content of phosphorus is defined as X mass %, the content of phosphorus, a content of Y mass % of sodium, and a content of Z mass % of strontium satisfy the following relationships: $0.45Y+0.24Z+0.003 \leq X \leq 0.45Y+0.24Z+0.01$; $0 \leq Y \leq 0.01$; and $0 \leq Z \leq 0.03$. The aluminum alloy ensures surface smoothness of a cast article by specifying the phosphorus content. This minimizes a surface segregation layer, even in production of a cast article using a molten metal containing a eutectic structure modifier such as sodium.

2 Claims, 1 Drawing Sheet

Plaster mold

Aluminum-alloy casted article

(51) Int. Cl.

| | |
|---|---|
| ***B22D 18/04*** | (2006.01) |
| ***B22D 21/04*** | (2006.01) |
| ***C22C 1/02*** | (2006.01) |

(56) References Cited

FOREIGN PATENT DOCUMENTS

| | | | | | |
|---|---|---|---|---|---|
| JP | 2002-080920 | A | | 3/2002 | |
| JP | 2004-269937 | A | | 9/2004 | |
| JP | 2007-031788 | A | | 2/2007 | |
| JP | 2012-132054 | A | | 7/2012 | |
| JP | 2016-098433 | A | | 6/2016 | |
| WO | WO-2016068293 | A1 | * | 5/2016 | ..... G11B 5/73 |

* cited by examiner

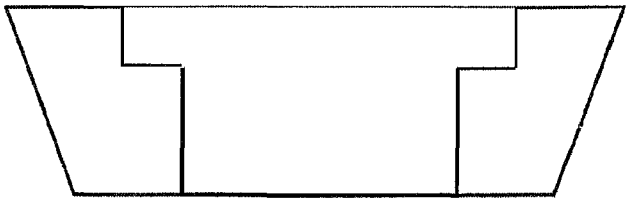
Plaster mold
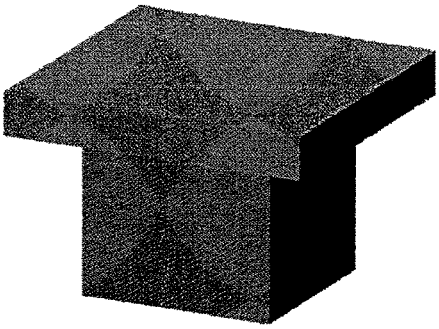
Aluminum-alloy casted article

ALUMINUM ALLOY FOR LOW-PRESSURE CASTING

TECHNICAL FIELD

The present invention relates to an aluminum alloy for low-pressure casting and a product thereof. More specifically, an alloy applied herein is a hypo-eutectic Al—Si alloy that improves smoothness of a surface of an aluminum-alloy casted article to be produced.

RELATED ART

Al—Si alloys, for their good fluidity and good transcription property, are used as alloys for casting such as gravity casting, low-pressure casting, and die-casting. In particular, Al—Si—Cu—Mg alloys are higher in strength and, as such, are used for engine parts and/or similar parts.

Casted products of these Al—Si alloys are required to have smoothness on the surfaces of the casted products. Some Al—Si alloy casted articles have a surface segregation layer in their outer layer structures. A surface segregation layer may occasionally have an influence on smoothness of a surface of a casted product. A surface segregation that occurs on a Al—Si alloy casted product is different from a surface segregation caused by eutectic melting of a slow-cooling region in continuous casting. Specifically, a surface segregation on an Al—Si alloy casted article refers to such a phenomenon that in a subsolidus phase region in which α-Al and a eutectic phase that are solidifying have crystallized to a substantial degree, a residual liquid-rich phase flows into an air gap on the surface of the Al—Si alloy casted article. In this respect, a surface segregation layer may not necessarily be formed at local positions, depending on how solidification progresses there. At the positions where no surface segregation layer is formed, a shrinkage cavity occurs extending inward from the surface and causing smoothness to degrade. In light of the circumstances, ensuring surface smoothness of a casted article necessitates a method of stably generating a surface segregation layer throughout the surface of the casted article or a method of preventing a surface segregation layer from occurring. As used herein, the outer layer refers to a portion to be filled with an aluminum alloy if the surroundings of the surface of a shape to be formed are normal; and the surface refers to a surface contacting the atmosphere.

One possible factor that influences the outer layer structure of an Al—Si alloy casted article is P (phosphorus). Generally, an Al—Si alloy is made to have a desired composition by combining an aluminum base metal and an Al—Si mother alloy and dissolving the combination. In the raw material Si, which is essential for preparation of the Al—Si mother alloy, which is a raw material of an Al—Si alloy, P is mixed in quantities that vary from approximately 0.001 to 0.01 mass %. That is, the P content in an Al—Si alloy depends on the P content in the Al—Si mother alloy used in the mixture of the Al—Si alloy. For example, in an Al-10% Si alloy, which is a hypo-eutectic Al—Si alloy, P exists in the range of approximately 0.0005 to 0.0015 mass %.

One influence that P has on a hypo-eutectic Al—Si alloy casted article is an increase in the number of cells of the eutectic phase. The number of cells of the eutectic phase is caused to increase when an excess of P beyond its solid solubility limit in the hypo-eutectic Al—Si alloy has crystallized as AlP, which serves as the nucleus of eutectic Si. An increase in the number of eutectic cells blocks the liquid phase channel in the subsolidus phase region, causing the efficiency with which molten metal is supplied to degrade. This makes a shrinkage cavity that extends inward from the surface more liable to occur locally in the outer layer. It is noted that P's solid solubility limit in a hypo-eutectic Al—Si alloy is 0.0002 to 0.0003 mass %.

Another influence that P has on a hypo-eutectic Al—Si alloy casted article is the problem of P's reaction to Na or Sr, which is used as eutectic structure modifier. In production of a hypo-eutectic Al—Si alloy casted article, Na or Sr is generally added as eutectic structure modifier for the purpose of making the eutectic Si phase finer. P in the hypo-eutectic Al—Si alloy casted article reacts to the eutectic structure modifiers Na and/or Sr to form the compound $Na_3P$ and/or $Sr_3P_2$. Thus, Na or Sr is consumed, resulting degraded effectiveness of the eutectic structure modifier.

Further, a hypo-eutectic Al—Si alloy casted article containing the eutectic structure modifiers Na and/or Sr may be faced with the problem of increased number of eutectic cells caused by the above-described formation of AlP, in addition to the problem of degraded effectiveness of the eutectic structure modifiers Na and/or Sr. The problem of increased number of eutectic cells may occur when the amount of P mixed in the hypo-eutectic Al—Si alloy is equal to or more than the amount of P that reacts to Na or Sr. That is, in this case, an excess of P that was not used to form the compound ($Na_3P$ or $Sr_3P_2$) with Na or Sr combines with Al to form AlP, resulting in an increase in the number of eutectic cells. With the increase in the number of eutectic cells, the efficiency with which molten metal is supplied is degraded, and depending on the shape of the mold, a surface segregation layer may not necessarily be formed at local positions in the outer layer of the casted article. This induces a shrinkage cavity that extends up to the surface to occur. This situation may possibly occur because P is mixed in the Al-10% Si alloy at approximately 0.0005 to 0.0015 mass %, as described above.

In hypo-eutectic Al—Si alloy casted articles, it is difficult to avoid the problem of P's reaction to the eutectic structure modifiers Na and/or Sr. This is because many molten metals of hypo-eutectic Al—Si alloy casted article contain eutectic structure modifier for operational reasons on production sites that produce a wide variety of alloys for Al—Si alloy casted articles. In production sites of Al—Si alloy casted articles, a typical residual molten metal in which eutectic structure modifier is added and a molten metal in which a developed scrap is used as a base are prepared in some cases. In common practice, these metals are mixed in appropriate manners to produce a wide variety of alloys. In some cases, the molten metal contains, for example, Na at 0.001% or more and Sr at 0.005% or more. In other cases, the molten metal is prepared using an aluminum alloy scrap containing eutectic structure modifier.

Thus, P contained in an Al—Si alloy is a factor that causes AlP to be formed, increasing the number of eutectic cells, and that causes reaction to the eutectic structure modifiers Na and/or Sr. As such, P can affect the surface structure of the alloy casted article. One possible measure against P contained in an Al—Si alloy is to remove P from the alloy molten metal. A method of removing P from a molten metal is proposed in, for example, patent document 1 as a dephosphorization method that uses calcium fluoride. Patent document 2 proposes a dephosphorization method that uses chlorine gas.

RELATED ART DOCUMENTS

Patent Documents

[Patent document 1] JP 2016-098433A.
[Patent document 2] JP 2002-080920A.

SUMMARY

Problems to be Solved by the Invention

The manners of reducing the P content proposed in patent documents 1 and 2 are fundamental approach on how to solve the problem of influence of P. It is not easy, however, to eliminate P from an aluminum alloy.

Additionally, the P content in an aluminum alloy depends on the aluminum base metal and the Al—Si mother alloy used in production of the aluminum alloy. It is, therefore, difficult to stably obtain the effects of the methods of reducing the P content recited in the patent documents. In particular, in a hypo-eutectic Al—Si alloy, to which the present invention is directed, a slight amount of P contained in the alloy has various kinds of influence on the final product. Further, performing dephosphorization treatment with respect to an alloy molten metal with adjusted chemical composition is an additional process step, which is hardly an appropriate approach from the viewpoint of the efficiency of casted article production.

Another possible measure against the problem of P in an aluminum alloy is to utilize the reaction of P to the eutectic structure modifiers Na and/or Sr. Specifically, P is caused to react to Na or Sr, instead of being removed from the Al—Si alloy, so as to eliminate P that otherwise forms AlP. Another alternative is conceivable such as adding Na or Sr excessively to supplement these elements that are canceled by P. However, adding an excessive amount of Na or Sr makes the fluidity of the molten metal prone to degrade. Thus, the local absence of a surface segregation layer, which is the fundamental factor causing a shrinkage cavity to occur, remains unsolved. Additionally, the products obtained by reaction of P with Na and with Sr (namely, $Na_3P$ and $Sr_3P_2$) are impurities, and if the products are formed in large amounts, the mechanical properties of the alloy casted article may be affected. Thus, there is a limitation to the measure that utilizes the eutectic structure modifiers Na and/or Sr.

Among hypo-eutectic Al—Si alloy casted articles, especially those produced by low-pressure casting are more frequently faced with the above-described problem associated with a surface segregation caused by certain alloy components, with a variety of failures caused to occur. In low-pressure casting, the material of the mold and the material of the chill plate differ from each other in many cases. For example, in low-pressure casting, the mold is a plaster mold, whereas the chill plate is made of iron or copper. When the mold and the chill plate differ from each other in material as described above, a surface segregation is more likely to occur in a casted article's outer layer that is on the side of the plaster mold wall because this side of outer layer is low in heat transfer coefficient. As a result, the above problem occurs.

The present invention has been made in view of the above-described problems, and provides a hypo-eutectic Al—Si alloy that improves the smoothness of a surface of a casted article. Specifically, the present invention provides an alloy that forms a smooth surface by preventing a surface segregation layer from occurring throughout the surface of the casted article regardless of whether the eutectic structure modifiers Na and/or Sr are added or not. The present invention also provides a casted product made of the alloy.

Means of Solving the Problems

As described above, a conventional measure against P in a hypo-eutectic Al—Si alloy was to remove P or utilize the eutectic structure modifiers Na and/or Sr. Both these measures are methods of preventing formation of AlP, which is a factor that causes eutectic cells. These conventional techniques involve the problem of difficulty in removing P and the problem of degraded fluidity of molten metal caused by an excessive amount of Na or Sr, which, though, prevents formation of AlP.

Incidentally, a primary objective of the present invention is to ensure smoothness of a surface of a hypo-eutectic Al—Si alloy casted article. That is, the objective, which is to ensure smoothness of a surface of a casted article, can be accomplished by an approach other than the conventional measure of preventing formation of AlP. In light of the circumstances, the inventors conducted extensive study and research, and attempted to adjust the content of P inevitably contained in a hypo-eutectic Al—Si alloy. As a result, the inventors conceived of containing, as necessary, an unusual amount of P in the hypo-eutectic Al—Si alloy intentionally.

As described above, an excess of P beyond its solid solubility limit in a hypo-eutectic Al—Si alloy forms AlP, which serves as the nucleus of a eutectic Si phase. The formation of AlP increases the number of eutectic cells, causing the efficiency with which molten metal is supplied to degrade and a shrinkage cavity extending up to the surface to be formed. According to the inventors, these adverse effects caused by eutectic cells are more likely to occur when the number of eutectic cells is not significantly large and these eutectic cells are roughly dispersed. Based on this finding, the inventors attempted to adjust the P content in a hypo-eutectic Al—Si alloy at a predetermined amount or more while taking the contents of the eutectic structure modifiers Na and/or Sr into consideration.

This measure taken by the inventors involves increasing the P content, contrary to the above conventional techniques. This change of perspective beyond the conventional techniques is based on the following speculation. The inventors speculated that if the number of eutectic cells are sufficiently increased by increasing Pin a hypo-eutectic Al—Si alloy, the time before the flow-limit solid-phase rate is reached can be shortened. Then, the inventors speculated that shortening the time before the flow-limit solid-phase rate is reached causes a solidified shell of a casted article to be formed earlier in the outer layer, making the surface of the casted article smooth, without a surface segregation.

With the above knowledge, the inventors conducted study on a preferable content of P in a hypo-eutectic Al—Si alloy of a predetermined composition while taking the contents of the eutectic structure modifiers Na and/or Sr into consideration. As a result, the inventors conceived of the present invention.

The present invention is an aluminum alloy for low-pressure casting, and the aluminum alloy is made of an Al—Si—Cu—Mg alloy and contains: 8.0 to 12.6 mass % of Si; 1.0 to 2.5 mass % of Cu; 0.3 to 0.8 mass % of Mg; and 0.2 mass % or less of Ti, wherein the aluminum alloy further contains X mass % of P, Y mass % of Na, and Z mass % of Sr, with the balance including Al and inevitable impurities, and wherein a content of P, a content of Na, and a content of Sr satisfy all of the following relationships: $0.45Y+0.24Z+0.003 \leq X \leq 0.45Y+0.24Z+0.01$; $0 \leq Y \leq 0.01$; and $0 \leq Z \leq 0.03$.

Effects of the Invention

The present invention provides an aluminum alloy for low-pressure casting, specifically a hypo-eutectic Al—Si alloy that enables production of an aluminum-alloy casted article with improved surface smoothness. This hypo-eutectic Al—Si alloy is superior in mechanical properties, and the resulting aluminum-alloy casted article is without surface shrinkage cavities throughout the surface of the casted article.

BRIEF DESCRIPTION OF THE DRAWINGS

FIG. 1 illustrates a shape of a plaster mold used in examples and an external shape of each aluminum-alloy casted article produced.

MODES FOR CARRYING OUT THE INVENTION

As described above, the aluminum alloy for low-pressure casting according to the present invention contains: 8.0 to 12.6 mass % of Si; 1.0 to 2.5 mass % of Cu; 0.3 to 0.8 mass % of Mg; and 0.2 mass % or less of Ti. The aluminum alloy further contains X mass % of P, Y mass % of Na, and Z mass % of Sr, with the balance including Al and inevitable impurities. The content of P, the content of Na, and the content of Sr (X, Y, Z) satisfy all of the following relationships: $0.45Y+0.24Z+0.003 \leq X \leq 0.45Y+0.24Z+0.01$; $0 \leq Y \leq 0.01$; and $0 \leq Z \leq 0.03$. An embodiment of the present invention will be described below. It is noted that the present invention will not be limited to the following embodiment, and it will be appreciated that the present invention may be practiced in various other embodiments without departing from the scope of the present invention. The following description gives a chemical composition of the aluminum alloy according to the present invention; an alloy casted article produced from this aluminum alloy; and a method for producing the alloy casted article.

<Chemical Composition>

First, names and contents of the alloy components of the aluminum alloy for low-pressure casting according to the present invention will be described, with reasons why the contents of the alloy components are thus limited.

Si:

The Si content is 8.0 to 12.6 mass %. At below 8.0 mass %, Si's fluidity degrades, causing molten metal mis-running. An Si content of 12.6 mass % or more is not preferable, either, in that a hyper-eutectic composition results, causing many coarse Si particles to crystallize and resulting in degraded strength. A preferable range of the Si content is 8.6 to 9.4 mass %.

Cu:

The Cu content is 1.0 to 2.5 mass %. Cu causes $AlCu_2$ to deposit in aging process and thus increases the matrix strength. At less than 1.0 mass %, this effect weakens, while in excess of 2.5 mass %, an Al—Cu—Mg intermetallic compound and a Cu—Mg intermetallic compound crystallize, resulting in degraded strength. A preferable range of the Cu content is 1.5 to 2.0 mass %.

Mg:

The Mg content is 0.3 to 0.8 mass %. Mg deposits as $Mg_2Si$ in aging process and thus increases the matrix strength. If the Mg content is less than 0.3 weight %, the amount of $Mg_2Si$ to deposit in aging treatment is small, making Mg less influential for increased strength. In contrast, if the Mg content is in excess of 0.8 weight %, many Mg oxides occur at the molten metal holding time and the casting time, causing extension and fatigue strength to degrade.

Ti:

The Ti content is more than 0 mass % and 0.2 mass % or less. Ti is used to make crystal grains fine. If the Ti content is in excess of 0.2 mass %, a coarse $TiAl_3$ compound is formed at the casting time, causing the strength of the final product to degrade.

It is noted that in the present invention, not only Ti but also B may be contained, in the form of Ti—B. This increases the effect of making crystal grains fine. When Ti—B is contained, preferable ranges of Ti and B are respectively 0.1 to 0.2 mass % and 0.003 to 0.005 mass %. If the contents of Ti and B are less than lower limits of their respective ranges, that is, if the contents of Ti and B are respectively less than 0.1 mass % and less than 0.003 mass %, the capability of making crystal grains fine is insufficient. If the contents of Ti and B are respectively in excess of 0.2 mass % and 0.005 mass %, no more effect of making crystal grains fine can be obtained. In addition, the resulting compound may be coarse enough to cause degraded strength.

P:

As has been described hereinbefore, the present invention ensures surface smoothness of a casted article by specifying an appropriate range of the P content. P reacts to Al to form AlP, which serves as the nucleus of Si particle formation, including a eutectic Si phase. In this respect, in specifying the P content in accordance with the present invention, the inventors have determined 0.003 to 0.01 mass % as a reference P content that serves as a basis of forming effective AlP for inducing a eutectic Si phase.

The P content range of reference values, 0.003 to 0.01 mass %, will be described. First, P's solid solubility limit in an aluminum alloy is 0.0003 mass %. That is, at 0.0003 mass % or less, P is entirely consumed in a solid solution with aluminum, becoming less influential in inducing a eutectic Si phase. In this case, the effects of the present invention are not expected. If the P content is in excess of 0.0003 mass % but less than 0.003 mass %, AlP can be formed but the number of nuclei of AlP is small, with AlP dispersed unpreferably. In this case, with small pieces of AlP roughly dispersed, the number of eutectic cells is at a level that has an adverse effect on the efficiency with which molten metal is supplied. This causes a surface segregation layer to be formed, inducing a local shrinkage cavity.

According to the inventors, in order to sufficiently increase the effective nucleus count of AlP, 0.003 mass % or more of P is necessary. In this case, the amount of AlP formed is sufficient enough to increase the number of eutectic cells. This shortens the time before the subsolidus phase state is reached and causes a solidified shell to be formed earlier in the outer layer, making the surface of the casted article smooth, without a surface segregation. It should be noted, however, that this effect obtained when P is 0.003 mass % or more remains unchanged in excess of 0.01 mass %. In light of these findings, the inventors determined the range of 0.003 mass % or more and 0.01 mass % or less as a reference P content that serves as a basis of forming effective AlP for ensuring surface smoothness of the casted article.

In the present invention, an approximate P content is set while the contents of the eutectic structure modifiers Na and/or Sr is taken into consideration. The chemical elements Na and Sr, which are contained in Al—Si alloys as eutectic structure modifier, are not always added intentionally in alloy production processes. That is, it is possible for Na and Sr derived from raw material to contaminate Al—Si alloys. Thus, Na and/or Sr get contained in alloys, especially in production of a wide variety of Al—Si alloy casted articles. In the present invention, the P content is set while the content of Na and/or Sr in an alloy taken into consideration, irrespective of whether Na and/or Sr have been intentionally added.

As described above, Na and Sr react to P to form compounds (such as $Na_3P$ and $Sr_3P_2$). In light of this, in the aluminum alloy according to the present invention, the P content after reaction to Na or Sr needs to be set within the above-described reference P content range (0.003 mass % or more and 0.01 mass % or less).

Specifically, the P content (X mass %) in the aluminum alloy according to the present invention relative to the Na content (Y mass %) and the Sr content (Z mass %) is $0.45Y+0.24Z+0.003 \leq X \leq 0.45Y+0.24Z+0.01$. In this relational expression, coefficient 0.45 of the amount of Na (Y) and coefficient 0.24 of the amount of Sr (Z) are values calculated according to stoichiometric ratios of the compounds $Na_3P$ and $Sr_3P_2$, which are formed as a result of reaction to P. Also in the above relational expression, the amount of P (0.45Y+0.24Z) calculated based on the amount of Na (Y) and the amount of Sr (Z) indicates an amount of P cancellation caused by reaction to these eutectic structure modifiers.

If the amount of P excluding the amount of P cancellation caused by the reactions to the eutectic structure modifiers is less than 0.003 mass %, AlP is roughly dispersed, resulting in a eutectic cell count that can adversely affect the efficiency with which molten metal is supplied. This causes a surface segregation layer to be formed, inducing a local shrinkage cavity. In contrast, if the amount of P excluding the amount of P cancellation caused by the chemical reactions to the eutectic structure modifiers is 0.003 mass % or more, the effective nucleus count of AlP increases sufficiently enough to increase the number of eutectic cells. This, as a result, shortens the time before the subsolidus phase state is reached and causes a solidified shell to be formed earlier in the outer layer. This prevents a shrinkage cavity from occurring, resulting in a smooth surface. The upper limit of the P content excluding the amount of P cancellation is 0.01 mass %. In excess of this upper limit, the effects of P remain unchanged. The above relational expression indicates these technically significant effects.

As described later, the upper limit value of the amount of Na (Y) is 0.01 mass %, and the upper limit value of the amount of Sr (Z) is 0.03 mass %. With this point taken into consideration, in the present invention, all of the relationships $\leq Y \leq 0.01$ and $Z \leq 0.03$ needs to be satisfied, in addition to the above relational expression being satisfied.

Thus, the present invention is characterized by adjusting the P content based on whether the eutectic structure modifiers Na and/or Sr are added or not and based on how much they are contained. As described above, an Al—Si alloy is generally obtained by combining an aluminum base metal and an Al—Si mother alloy and dissolving the combination. In this manner, an alloy whose composition is adjusted as desired is obtained. Even though the aluminum base metal and the Al—Si mother alloy are combined and dissolved, there may be a deficiency in the P content. In light of the circumstances, it is preferable to adjust the P content by adding an appropriate amount of P in the alloy solution (for example, adding P in the form of Cu—P mother alloy).

Modifier (Na, Sr):

In the present invention, the eutectic structure modifiers Na and Sr are optional chemical elements. Therefore, at least one of the contents of Na and Sr may be 0 mass %. It should be noted, however, that at least one of Na and Sr may be contained. When at least one of Na and Sr is contained, it is preferable that the content of Na be 0.01 mass % or less, and the content of Sr be 0.03 mass % or less. These contents are added-amounts in general hypo-eutectic Al—Si alloys, and the present invention also employs these ranges of contents. Na and Sr react to P to respectively form $Na_3P$ and $Sr_3P_2$, and these compounds remain in the molten metal as impurities. In the present invention, a comparatively large amount of P is contained. Therefore, if the contents of Na and Sr are greatly varied, more impurities may possibly occur. More impurities cause mechanical properties such as fatigue strength to degrade. Also, as described above, excessive addition of Na and Sr serves as a factor that causes the fluidity of molten metal to degrade. In light of the circumstances, the general usage upper limits, Na: 0.01% and Sr: 0.03%, also apply in the present invention. Na and Sr may be added in the alloy by utilizing a molten metal containing modifiers, in particular, an aluminum alloy scrap in which modifiers are contained, as practiced in production sites. It should be noted, however, that the addition of the eutectic structure modifiers Na and/or Sr is optional, as described above.

Other Chemical Elements:

Other chemical elements than the above-described chemical elements may basically be Al and inevitable impurities. Still, other chemical elements than the above-described chemical elements added in the aluminum alloy are generally tolerated within ranges that will not greatly influence the characteristics and properties of the aluminum alloy.

<Surface Quality of Aluminum-alloy Casted Article>

The above-described aluminum alloy according to the present invention is suitable for production of aluminum-alloy casted articles by low-pressure casting methods. After casting, many of these casted articles are used without surface treatment and surface cutting. In light of the circumstances, such aluminum-alloy casted articles are preferably without a shrinkage cavity defect having a depth of 20 μm or more on the surfaces of the aluminum-alloy casted articles. Specifically, the area ratio of a shrinkage cavity having a depth of 20 μm or more on each of the surfaces is preferably 1% or less per 100 $mm^2$. This is because if a shrinkage cavity on a surface of a casted article is in excess of 20 μm and extends inward, it is highly possible for the defect to develop into a crack, resulting in a broken casted article.

<Method for Producing Aluminum-Alloy Casted Article>

The aluminum alloy obtained in the present invention can be made into an aluminum-alloy casted article by being dissolved into a molten metal of a desired chemical composition and then being poured into a mold and formed into a desired shape.

The molten metal that has been poured into the mold is cooled in a direction from a chill plate disposed above the mold toward the sprue of the mold. At the same time, the molten metal is applied an air pressure of more than 0 and 1 or less. Then, the formed article is subjected to solutionizing treatment, hardening, and artificial aging treatment. In this manner, the formed article is imparted a strength.

EXAMPLES

In the following description, examples of the present invention will be described in comparison with comparative examples, so as to prove the effects of the present invention. These examples are provided as examples of one embodiment of the present invention and will not limit the present invention.

In the examples, aluminum-alloy molten metals adjusted to chemical compositions listed in Table 1 were produced. Then, according to an aluminum-alloy molten metal low-pressure casting method, each molten metal at 750° C. was poured into a plaster mold of 200° C., and solidified using an iron chill plate of 200° C. In this manner, an aluminum-alloy casted article was obtained. FIG. 1 illustrates a shape of the plaster mold used here and an external shape of the aluminum-alloy casted article produced. Then, the aluminum casted article produced was evaluated in terms of surface structure and mechanical properties according to the following methods.

TABLE 1

| | Composition (mass %) | | | | | | | | |
|---|---|---|---|---|---|---|---|---|---|
| | Si | Cu | Mg | Ti | B | P | Na | Sr | Al |
| Example 1 | 8.10 | 1.80 | 0.50 | 0.12 | 0.0032 | 0.0033 | — | — | Balance |
| Example 2 | 12.50 | 1.50 | 0.60 | 0.10 | 0.0046 | 0.0052 | — | — | Balance |
| Example 3 | 9.20 | 1.00 | 0.80 | 0.15 | 0.0030 | 0.0044 | — | — | Balance |
| Example 4 | 9.00 | 2.40 | 0.40 | 0.18 | 0.0035 | 0.0071 | — | — | Balance |
| Example 5 | 8.40 | 1.60 | 0.30 | 0.16 | 0.0031 | 0.0069 | — | — | Balance |
| Example 6 | 9.30 | 1.20 | 0.80 | 0.15 | 0.0038 | 0.0037 | — | — | Balance |
| Example 7 | 9.00 | 1.10 | 0.60 | 0.02 | 0.0049 | 0.0058 | — | — | Balance |
| Example 8 | 8.70 | 1.70 | 0.50 | 0.20 | 0.0042 | 0.0049 | — | — | Balance |
| Example 9 | 10.20 | 1.90 | 0.50 | 0.14 | 0.0045 | 0.0032 | — | — | Balance |
| Example 10 | 11.60 | 1.60 | 0.70 | 0.15 | 0.0039 | 0.0217 | 0.010 | 0.030 | Balance |
| Example 11 | 9.10 | 1.90 | 0.60 | 0.12 | 0.0005 | 0.0037 | — | — | Balance |
| Example 12 | 9.30 | 1.10 | 0.50 | 0.10 | 0.0046 | 0.0051 | 0.002 | — | Balance |
| Example 13 | 9.00 | 1.90 | 0.60 | 0.15 | 0.0035 | 0.0072 | — | 0.010 | Balance |
| Example 14 | 10.30 | 1.30 | 0.70 | 0.16 | 0.0033 | 0.0093 | 0.010 | — | Balance |
| Example 15 | 9.70 | 1.80 | 0.50 | 0.18 | 0.0041 | 0.0127 | — | 0.030 | Balance |
| Example 16 | 11.10 | 1.50 | 0.40 | 0.11 | 0.0022 | 0.0198 | 0.010 | 0.030 | Balance |
| Comparative example 1 | 5.00 | 1.30 | 0.60 | 0.12 | 0.0024 | 0.0036 | — | — | Balance |
| Comparative example 2 | 15.00 | 1.50 | 0.70 | 0.15 | 0.0041 | 0.0082 | — | — | Balance |
| Comparative example 3 | 9.50 | 0.50 | 0.50 | 0.12 | 0.0042 | 0.0071 | — | — | Balance |
| Comparative example 4 | 8.80 | 3.52 | 0.60 | 0.19 | 0.0032 | 0.0048 | — | — | Balance |
| Comparative example 5 | 8.20 | 1.90 | 0.20 | 0.11 | 0.0038 | 0.0033 | — | — | Balance |
| Comparative example 6 | 10.30 | 1.30 | 1.20 | 0.08 | 0.0021 | 0.0058 | — | — | Balance |
| Comparative example 7 | 11.40 | 1.50 | 0.80 | 0.23 | 0.0015 | 0.0097 | — | — | Balance |
| Comparative example 8 | 9.60 | 1.60 | 0.40 | 0.13 | 0.0045 | 0.0011 | — | — | Balance |
| Comparative example 9 | 9.10 | 1.40 | 0.70 | 0.1 | 0.0006 | 0.0015 | 0.002 | — | Balance |
| Comparative example 10 | 10.20 | 1.90 | 0.60 | 0.11 | 0.0019 | 0.0028 | — | 0.010 | Balance |
| Comparative example 11 | 9.20 | 1.90 | 0.60 | 0.15 | 0.0031 | 0.0081 | 0.008 | 0.015 | Balance |
| Comparative example 12 | 9.00 | 1.90 | 0.50 | 0.15 | 0.0032 | 0.0168 | 0.015 | — | Balance |
| Comparative example 13 | 9.10 | 1.10 | 0.50 | 0.12 | 0.0046 | 0.0196 | — | 0.040 | Balance |

<Evaluation of Surface Structure>

First, each casted article was evaluated as to whether there were surface defects on the surfaces of the casted article. Specifically, liquid penetrant testing was conducted according to JIS Z 2342 to check whether there was, throughout the surfaces of the casted article, a fluorescent point that had a depth of 20 μm or more and that extended inward from each surface. When there was a fluorescent point (shrinkage cavity), the area of the fluorescent point was measured and the area ratio per 100 $mm^2$ was calculated. When the area ratio was in excess of 1%, the fluorescent point was determined as a surface defect.

<Evaluation of Mechanical Properties>

Mechanical properties, namely, tensile strength, proof strength, and extension were measured. In the measurement of these mechanical properties, a round bar tensile test piece specified by JIS Z 2201 was cut out of a center portion of each casted article, and the round bar tensile test piece was subjected to the measurement according to a JIS Z 2241 test method at room temperature. Then, the measured tensile strength, proof strength, and extension were checked as to whether they were equal to or more than values (tensile strength: 370 MPa, 0.2% proof strength: 270 MPa, and extension: 7% or more) measured from an Al—Si aluminum alloy for low-pressure casting that was produced according to a conventional technique that involved adding Na.

Evaluation results of the surface structure and the mechanical properties of the aluminum casted articles produced in the examples are listed on Table 2.

TABLE 2

| | TS [MPa] | | YS [MPa] | | EI [%] | | P content [wt %] Lower limit value based on expressions | P content [wt %] Content | Surface defect |
|---|---|---|---|---|---|---|---|---|---|
| Example 1 | 411 | ○ | 308 | ○ | 9.2 | ○ | 0.0030 | 0.0033 | None |
| Example 2 | 380 | ○ | 301 | ○ | 7.6 | ○ | | 0.0052 | None |
| Example 3 | 372 | ○ | 280 | ○ | 9.9 | ○ | | 0.0044 | None |
| Example 4 | 423 | ○ | 311 | ○ | 7.2 | ○ | | 0.0071 | None |
| Example 5 | 381 | ○ | 296 | ○ | 8.8 | ○ | | 0.0069 | None |
| Example 6 | 401 | ○ | 302 | ○ | 9.6 | ○ | | 0.0037 | None |
| Example 7 | 397 | ○ | 288 | ○ | 8.3 | ○ | | 0.0058 | None |
| Example 8 | 408 | ○ | 297 | ○ | 10.0 | ○ | | 0.0049 | None |
| Example 9 | 403 | ○ | 305 | ○ | 9.2 | ○ | | 0.0032 | None |
| Example 10 | 401 | ○ | 302 | ○ | 8.1 | ○ | 0.0147 | 0.0217 | None |
| Example 11 | 401 | ○ | 302 | ○ | 8.1 | ○ | 0.0030 | 0.0037 | None |
| Example 12 | 372 | ○ | 290 | ○ | 7.6 | ○ | 0.0039 | 0.0051 | None |
| Example 13 | 388 | ○ | 288 | ○ | 8.0 | ○ | 0.0054 | 0.0072 | None |
| Example 14 | 415 | ○ | 291 | ○ | 7.5 | ○ | 0.0075 | 0.0093 | None |
| Example 15 | 399 | ○ | 276 | ○ | 7.9 | ○ | 0.0102 | 0.0127 | None |
| Example 16 | 405 | ○ | 275 | ○ | 7.7 | ○ | 0.0147 | 0.0198 | None |
| Comparative example 1 | 363 | x | 250 | x | 9.4 | ○ | 0.0030 | 0.0036 | Identified |
| Comparative example 2 | 345 | x | 210 | x | 1.3 | x | | 0.0082 | None |
| Comparative example 3 | 310 | x | 234 | x | 8.1 | ○ | | 0.0071 | None |
| Comparative example 4 | 422 | ○ | 283 | ○ | 3.3 | x | | 0.0048 | None |
| Comparative example 5 | 351 | x | 280 | ○ | 8.9 | ○ | | 0.0033 | None |
| Comparative example 6 | 388 | ○ | 278 | ○ | 6.6 | x | | 0.0058 | None |
| Comparative example 7 | 381 | ○ | 281 | ○ | 4.2 | x | | 0.0097 | None |
| Comparative example 8 | 391 | ○ | 304 | ○ | 8.9 | ○ | | 0.0011 | Identified |
| Comparative example 9 | 376 | ○ | 281 | ○ | 8.2 | ○ | 0.0039 | 0.0015 | Identified |
| Comparative example 10 | 395 | ○ | 267 | ○ | 8.8 | ○ | 0.0054 | 0.0028 | Identified |
| Comparative example 11 | 388 | ○ | 314 | ○ | 5.5 | x | 0.0102 | 0.0081 | Identified |
| Comparative example 12 | 372 | ○ | 274 | ○ | 6.5 | x | 0.0098 | 0.0168 | None |
| Comparative example 13 | 375 | ○ | 277 | ○ | 6.3 | x | 0.0126 | 0.0196 | None |

TS (tensile strength): 370 MPa or more was accepted (○).

YS (0.2% proof strength): 270 MPa or more was accepted (○).

EI (extension): 7% or more was accepted (○).

Surface defect: A shrinkage cavity having a depth of 20 μm or more and having an area ratio over 1% was "identified" as a surface defect.

Table 2 shows that in Example 1 through Example 16, the components Si, Cu, Mg, and Ti are within the respective ranges specified in the present invention. Also, the P content is appropriately adjusted. As a result, the aluminum-alloy casted articles of the examples had no defects of 20 μm or more on the surfaces of the aluminum-alloy casted articles, having satisfactory surface smoothness. Also, the mechanical properties, namely, tensile strength, proof strength, and extension satisfied the respective reference values.

In contrast, in Comparative example 1 through Comparative example 7, the components Si, Cu, Mg, and Ti were outside their respective corresponding ranges specified in the present invention, and thus were inferior in the smoothness of the casted article surfaces or in the mechanical properties. Specifically, the following results were obtained.

In Comparative example 1, there was a deficiency in Si, causing tensile strength and proof strength to be equal to or less than their respective corresponding reference values. Further, because of insufficient fluidity, there was a defect of 20 μm or more on the casted article surface. Thus, Comparative example 1 was rejected.

In Comparative example 2, there was an excessive amount of Si, resulting in a hyper-eutectic alloy whose tensile strength, proof strength, and extension were all below their respective corresponding reference values of an aluminum alloy for low-pressure casting. Thus, Comparative example 2 was rejected.

In Comparative example 3, there was a deficiency in Cu, causing tensile strength and proof strength to be equal to or less than their respective corresponding reference values. Thus, Comparative example 3 was rejected. In contrast, in Comparative example 4, there was an excessive amount of Cu, causing extension to be equal to or less than its corresponding reference value. Thus, Comparative example 4 was rejected.

In Comparative example 5, there was a deficiency in Mg, causing tensile strength to be equal to or less than its corresponding reference value. Thus, Comparative example 5 was rejected. In contrast, in Comparative example 6, there was an excessive amount of Mg, causing extension to be equal to or less than its corresponding reference value. Thus, Comparative example 6 was rejected.

In Comparative example 7, there was an excessive amount of Ti, causing extension to be equal to or less than its corresponding reference value. Thus, Comparative example 7 was rejected.

In comparative examples 8 to 11, the P contents were lower than the lower limit value that is based on the relational expressions of the present invention (comparative example 8: 0.003 mass %, Comparative example 9: 0.0039 mass %, Comparative example 10: 0.0054 mass %, and Comparative example 11: 0.0102 mass %). The alloys of these comparative examples had defects of 20 μm or more on the surfaces of the alloys. Thus, these comparative examples were rejected. The P contents in these comparative examples were in excess of their solid solubility limit in Al—Si alloys, and were lower than the lower limit value specified in the present invention. This led to the assumption that while an excess of P beyond its solid solubility limit formed AlP, the number of eutectic cells was at a level that had an adverse effect on the efficiency with which molten metal was supplied, causing a surface segregation layer to be formed, which induced a shrinkage cavity.

In Comparative examples 12 and 13, Na and Sr were in excess of their respective upper limits (Na: 0.01 mass %, and Sr: 0.03 mass %), causing extension to be equal to or less than its corresponding reference value. Thus, these comparative examples were rejected. These comparative examples contained comparatively large amounts of P, and it is assumed that this P reacted to Na or Sr to form $Na_3P$ or $Sr_3P_2$, which remained in the molten metal as impurities. These comparative examples contained large amounts of impurity compounds, which presumably led to the degraded extension of the alloy casted articles produced.

INDUSTRIAL APPLICABILITY

In the aluminum alloy for low-pressure casting according to the present invention, the P content is appropriately controlled with the contents of Na and/or Sr taken into consideration. This enables an aluminum-alloy casted article with improved surface smoothness to be produced. The aluminum-alloy casted article made of the hypo-eutectic Al—Si alloy produced in the present invention is superior in mechanical properties and has a smooth surface, without a surface shrinkage cavity throughout the surface. The present invention, taking advantage of its mechanical properties, has utility in engine parts and/or similar parts.

The invention claimed is:

1. An aluminum alloy for casting, comprising an Al—Si—Cu—Mg alloy, wherein the aluminum alloy consists of 8.0 to 12.6 mass % of Si; 1.0 to 2.5 mass % of Cu; 0.3 to 0.8 mass % of Mg; and 0.2 mass % or less of Ti, 0.003 to 0.01 mass % of P, 0.003 to 0.005 mass % of B, optional chemical elements Y mass % of Na and Z mass % of Sr, with the balance of the aluminum alloy being aluminum and any impurities, and wherein, when a content of P is defined as X mass %, the content of P, a content of Na, and a content of Sr satisfy all of the following relationships: $0.45Y+0.24Z+0.003 \leq X \leq 0.45Y+0.24Z+0.01$; $0 \leq Y \leq 0.01$; and $0 \leq Z \leq 0.03$.

2. An aluminum-alloy cast article comprising the aluminum alloy for casting according to claim 1, wherein an area ratio of a shrinkage cavity defect having a depth of 20 μm or more on a surface of the aluminum-alloy cast article is 1% or less per 100 $mm^2$.

* * * * *